United States Patent [19]

Van Winkle

[11] Patent Number: 4,646,825

[45] Date of Patent: Mar. 3, 1987

[54] BLOWOUT PREVENTER, SHEAR RAM, SHEAR BLADE AND SEAL THEREFOR

[76] Inventor: Denzal W. Van Winkle, P.O. Box 79727, Houston, Tex. 77279

[21] Appl. No.: 812,917

[22] Filed: Jan. 2, 1986

[51] Int. Cl.[4] ..... E21B 29/08

[52] U.S. Cl. ..... 166/55; 277/129

[58] Field of Search ..... 166/55, 297; 72/326, 72/464; 83/694; 30/92; 277/129

[56] References Cited

U.S. PATENT DOCUMENTS

| | | | |
|---|---|---|---|
| 3,561,526 | 2/1971 | Williams, Jr. | 166/55 |
| 3,946,806 | 3/1976 | Meynier, III | 166/55 |
| 4,313,496 | 2/1982 | Childs et al. | 166/55 |
| 4,519,577 | 5/1985 | Jones | 251/62 |
| 4,537,250 | 8/1985 | Troxell, Jr. | 166/55 |

FOREIGN PATENT DOCUMENTS 1556914 11/1979 United Kingdom .

2051927 1/1981 United Kingdom .

OTHER PUBLICATIONS

Texas Oil Tool Inc., Shear Ram Assembly, Drawing #8011-0821 rev. A, approximately Dec. 1980.

*Primary Examiner*—James A. Leppink
*Assistant Examiner*—Hoang C. Dang
*Attorney, Agent, or Firm*—Jack W. Hayden

[57] ABSTRACT

Opposed rams are sealably and reciprocally mounted in a body with opposed shear blades projecting from one end of each ram for movement toward each other to sever an elongated object extending between the rams and blades. A seal is provided on each blade and configured to sealingly receive therein the exposed portion of the opposed blade after the object has been severed, and each ram is provided with a cut out portion to receive the adjacent severed end of the elongated object to inhibit crushing thereof.

3 Claims, 7 Drawing Figures

FIG. 3
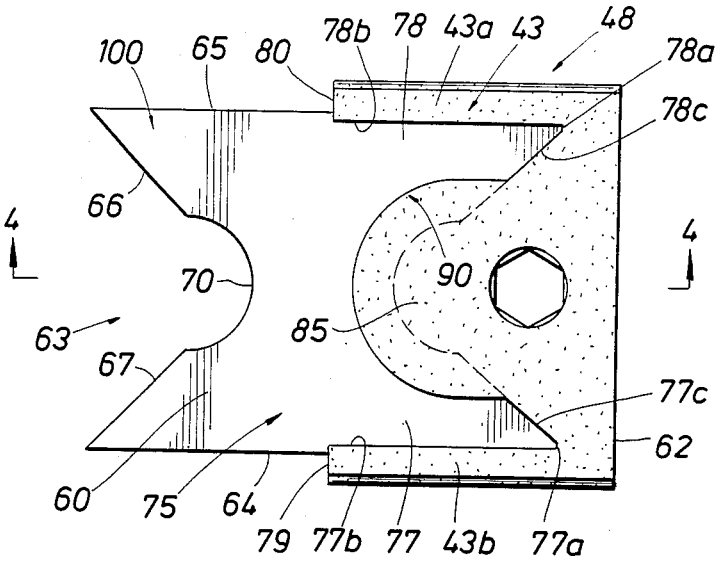
FIG. 5
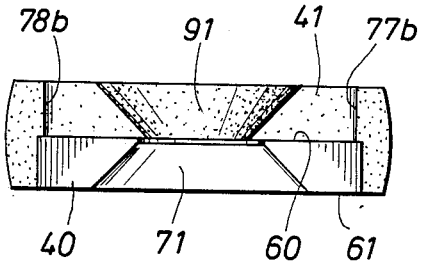
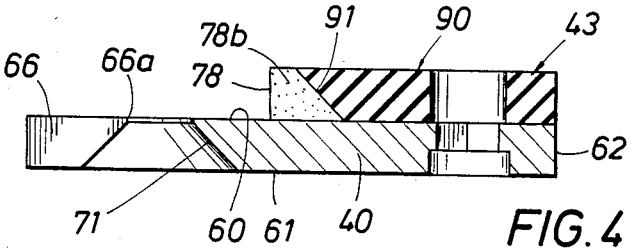
FIG. 4
FIG. 6
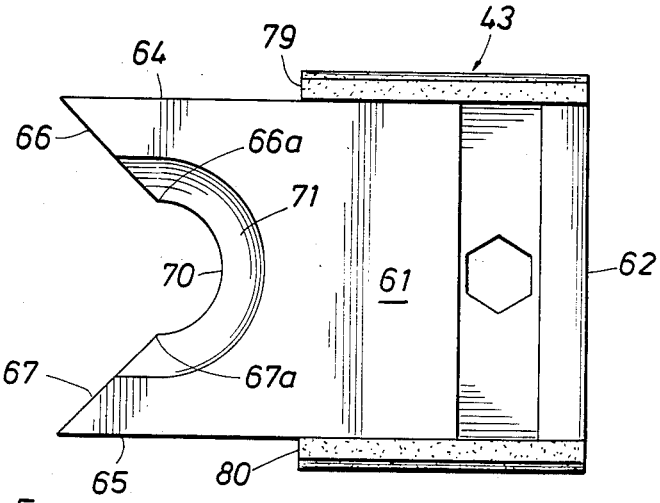
FIG. 7
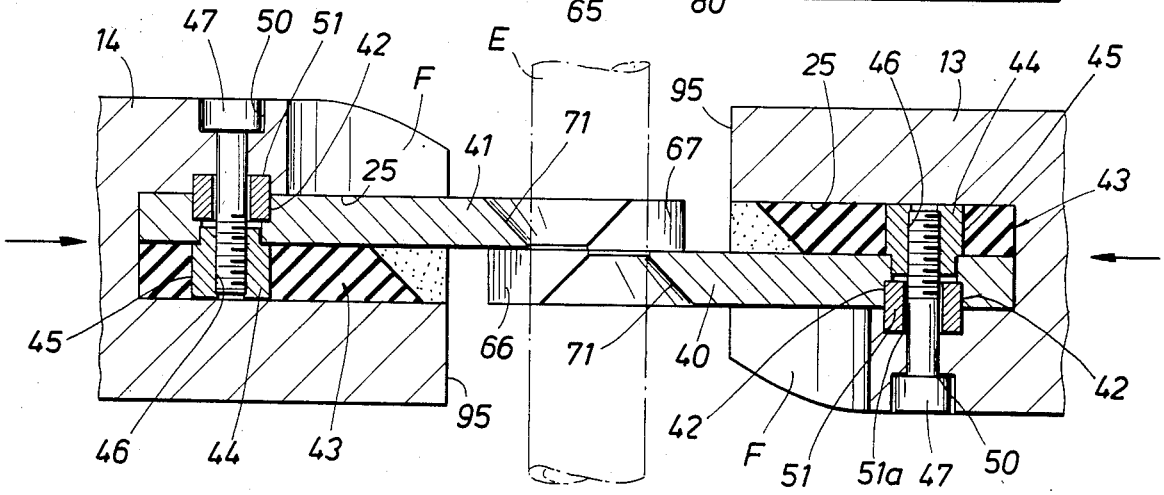

BLOWOUT PREVENTER, SHEAR RAM, SHEAR BLADE AND SEAL THEREFOR

CROSS REFERENCE TO RELATED APPLICATIONS

The subject matter of this patent application is related to application Ser. No. 810,310, filed on Dec. 23, 1985 for "Bonded Mechanical Interconnected Seal Arrangement for a Blowout Preventer" and also to application Ser. No. 807,735, filed on Dec. 16, 1985 for "Self Actuating Locking and Unlocking Arrangement and Method for Reciprocating Piston Type Actuators".

BACKGROUND OF THE INVENTION

Various arrangements have heretofore been provided and are in use for endeavoring to shear or sever elongated objects such as tubular members or cable which extend through a blowout preventer and then attempting to block or seal off communication through the blowout preventer after the tubular object has been sheared. Some of such devices include shear arrangements which are generally rectangularly in configuration but the configuration or arrangement is such that it may collapse or crush the ends of the tubular member being severed, particularly where the member is thin walled. Also, the sealing arrangement employed with such shear blades is generally unsatisfactory in that it may not adequately and positively seal or block off communication through the preventer after the tubular members or other object has been severed.

When pipe is severed or sheared in connection with drilling and production of oil and gas wells, it is common to provide a plurality of various types blowout preventers during the operation. For example, pipe rams of a blowout preventer are moved to closed position about the pipe or object to be sheared so that the well bore annulus therebeneath is sealed off. It is not uncommon for the pipe rams to be closed about the pipe immediately beneath a coupling or collar so that the pipe is then supported on the closed pipe rams after it has been sheared or severed.

A blowout preventer with shear rams is positioned in spaced relation above the preventer with pipe rams and it is actuated to shear the pipe and thereafter the portion of the sheared pipe above the shear rams is elevated by the draw works and drilling mast structure at the earth surface so that still another blowout preventer in spaced relation above the preventer with the shear rams may be actuated to close blind rams and prevent communication through the well bore above the sheared off section.

Thereafter the portion of the pipe or object above the shear rams is removed from the well bore and a suitable milling tool is lowered on a well string to engage the sheared end of the tubular member or object supported on the closed pipe rams to mill it off where it has been collapsed by the shear rams so that the pipe may be engaged by a fishing tool for recovery, or so that fluid may be communicated down through the exposed open end of the pipe to "kill" the well to inhibit "kicking" or a blowout in the well. In some situations pipe rams are provided above blind rams in the well bore which are closed against the well string during the milling operation.

The foregoing operation is expensive and time consuming.

SUMMARY OF THE INVENTION

The present invention provides a blowout preventer with a shear ram and a shear blade constructed and arranged to inhibit collapsing or crushing of the pipe when it is sheared so that the upper end of the sheared portion of the pipe remains upstanding and open with a shape to enable communication to be established through the severed, upstanding pipe end while the rams of the pipe ram blowout preventer supporting the pipe remain in closed, sealed position below the upstanding severed end of the pipe.

This eliminates the milling operations heretofore necessary to open the crushed end of the pipe, saving substantial expense.

The blowout preventer is constructed and arranged so as to accomplish the shearing in a mannr to substantially eliminate the crushing or collapsing of the pipe where the shear or severing is effected, and seal means are provided to seal the rams and the shear blades of the blowout preventer to inhibit communication therethrough from the well bore.

The rams of the blowout preventer are provided with a configuration to enable each end of the severed pipe to be moved or received therein as the pipe is severed to inhibit crushing or collapsing of the severed pipe ends, as is common with the prior art. The seal means associated with the shear blade of the present invention is configured to telescopically receive and evelope the exposed ends of the opposed shear blade to inhibit undesired fluid communication through the well bore.

The present invention provides an arrangement for shearing an elongated object extending through the bore of a device such as a blowout preventer and seal means associated with the shear structure for telescopically and sealingly receiving therein the opposed shear after the elongated object has been severed to block communication through the device.

The seal is preferably bonded with the shear and is provided with a recess therein to telescopically and sealingly receive the opposed shear of the device after the elongated object has been severed whereby fluid communication through the device is prevented by the sealing arrangement of the shears.

Other objects and advantages of the present invention will become more readily apparent from a consideration of the following drawings and descriptions.

BRIEF DESCRIPTION OF THE DRAWINGS

FIG. 3 is a plan view of a prefered form of the blade, or shear which may be use with a blowout preventer;

FIG. 4 is a sectional view of the line 4—4 of FIG. 3 to illustrate the details of the shear blade;

FIG. 5 is an end view looking from the shear surface toward the recess of the seal on the shear blades;

FIG. 6 is a bottom view of the shear blade;

FIG. 7 is a diagrammatic sectional view illustrating opposed rams of a blowout preventer with opposed shear blades supported thereby and diagrammatically representing the shear blades with the sealing element on each as they move toward overlapping, shearing relation for subsequent sealing engagement.

DESCRIPTION OF THE PREFERRED EMBODIMENT

Figure 1:
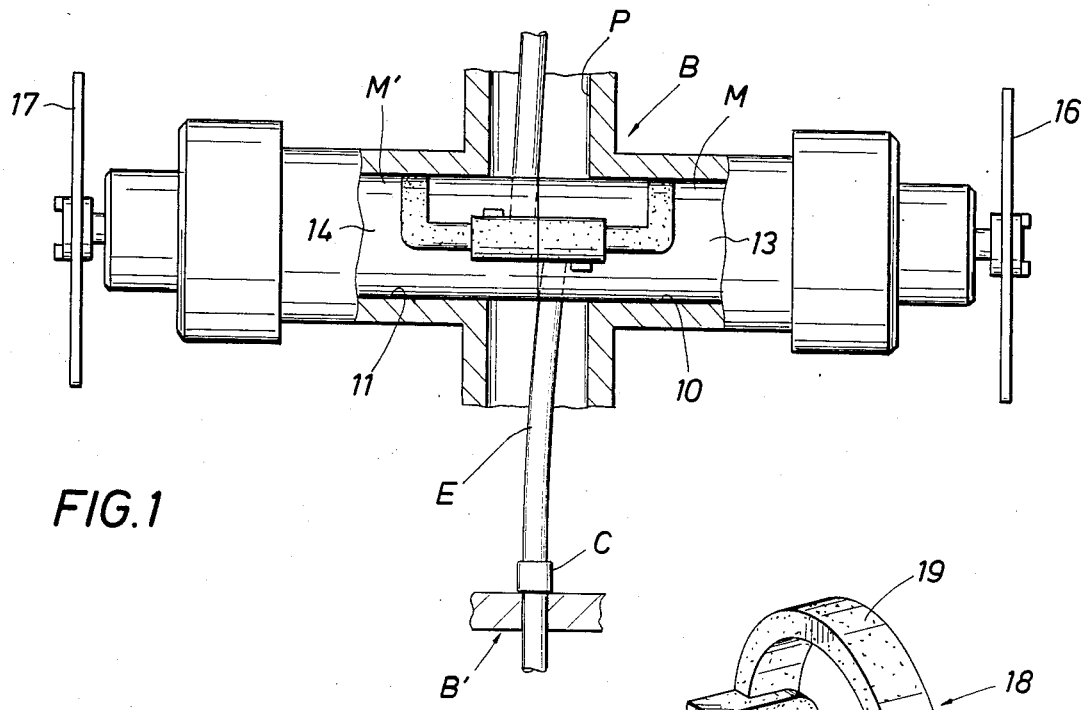
FIG. 1 is a side elevational view partly in section illustrating a device such as a blowout preventer with a pair of opposed shear means in sealing relation after they have been reciprocated or moved in the device to sever an elongated object and block off the passage or bore in the device through which the elongated object extends.

Attention is first directed to FIG. 1 of the drawing wherein a body B is shown which represents the body of any suitable device, and as shown is a blowout preventer. It can be appreciated that the present invention may be used in any situation or with any device where it is desired to sever elongated objects, and its description in relation to a blowout preventer is merely by way of illustration. The body B has a bore or passage P therethrough and suitable members M and M' are supported in opposed guideways 10 and 11 which extend laterally of and communicate with the passage P as shown. In describing the present invention the members M and M' are blowout preventer rams 13 and 14 which are provided with suitable means at their rear end as represented at 15 in FIG. 2 for connection with any suitable mechanism as shown at 16 and 17 whereby the rams 13 and 14 may be reciprocated within the guideways 10 and 11 toward and away from each other as will be described. The rams 13 and 14 are each provided with suitable seal means referred to generally at 18 which include a circumferential portion 19 and a longitudinal portion 20 which is received in the groove 21 and 22 respectively of each ram 13, 14 to sealingly engage in the guideways 10 and 11 as the rams 13 and 14 are reciprocated therein.

A slot 25 extends longitudinally of and across the forward end of each ram and is provided to receive the shear blade referred to generally by the numeral 30.

In the embodiment illustrated, the slot 25 is substantially in the center of the cylindrical rams. The blades 40, 41 are relatively thin in relation to the diameter of the rams, and the blades 40, 41 are the only portion which contact the elongated object to sever it and this coupled with the cut out portion F in each ram face 95 inhibit crushing during or after severing of the object E, as will be described.

The shear blade 30 is removably secured with each opposed ram in any suitable manner and as shown in FIG. 7 each annular ram body 13, 14 is provided with a lateral passage 50 that communicates at its inner end with the longitudinally extending groove 25 on the forward end of each annular ram body 13 and 14. A bar 51 extends in the slot 42 of each shear blade 40 and 41. Each shear blade is provided with seal means 43 formed of any suitable elastomer and of a suitable configuration for sealingly and telescopically receiving the exposed portion of the opposite shear blade when the rams 13 and 14 have been moved to the position shown in FIG. 1 of the drawings. It can be appreciated that the shear blades 40, 41 are mirror images of each other in that the seal means 43 on each blade is identically configured, assuming that the portion of each blade to be sealing received by the seal means 43 is identical. Generally speaking it is desirable that the blade configurations be identical, but one blade is merely turned over in relation to the other as viewed in FIG. 7 when they are positioned in their respective rams. A nut 44 is seated in the passage 45 of the seal means 43 on each blade 40, 41 and each nut 44 is provided with a threaded bore 46 for engaging with the bolt 47 which extends through the bore 50 of each ram 13, 14 as shown as well as through the opening 51*a* in bar 51 to be threadedly received in the bore 46 of the nut 44. This secures the shear plate of each ram in position and retains it in position during reciprocating movement of the rams toward closed position as viewed in FIG. 1 and away from each other to open position.

As previously noted the plates 40, 41 are preferably identical in configuration and arrangement of the seal means 43 thereon. Each shear blade 40 includes spaced, parallel longitudinally extending surfaces 60 and 61 which may be termed upper and lower. It can be appreciated that the term "upper" and "lower" will be reversed for the other plate. Each shear blade is generally rectangular in shape and includes in addition to the generally flat upper and lower parallel surfaces 60 and 61 back surface 62 and front surface generally referred to by the numeral 63 and which will be described in greater detail hereinafter. In addition, side surfaces 64 and 65 extend longitudinally, and the side, back and front surfaces extend between surfaces 60, 61 to connect with the flat laterally extending surfaces 60 and 61 as shown.

The front surface 63 provides the shear surface for each shear blade 40, such shear surface being defined by the converging guide surfaces 68 and 67 which extend inwardly from each edge surface 64, 65 as shown and terminate at their inner ends 66*a*, 67*a* in an acurate portion 70. The acurate portion 70 has an annular acurately tapered cutting surface 71 that extends on a diagonal plane between the upper and lower surfaces 60 and 61 of the shear blades 40 and 41 as shown. If desired the portion of the cutting surface 71 where it approaches the surface 60 may terminate in slight spaced relationship to the surface 60 as shown in the drawings so as to not provide a sharp edge that might chip during the severing or shearing operation.

The seal means 43 is molded on each blade adjacent the rear portion thereof referred to generally by the numberal 48. The seal means 43 is molded along said side surfaces 64 and 65 and may overlap them slightly adjacent the surface above which the seal means extends such as the surface 60 as illustrated in the drawings. The seal means 43 also is bonded to , and extends across the surface 60 along the rear edge 62 and extends over an adjacent portion of at least one of said parallel surfaces, which is shown as being the surface 60 in the drawings. The seal means 43 is further provided with a recess referred to generally at 75 that extends adjacent the parallel surface portion to which the seal means is molded and bonded. The recess 75 is defined by longitudinally extending recess portions 77 and 78 which extend adjacent each side surface 64, 65 from the position 79 and 80 which define ends where the seal means 43 terminates along the side surfaces 64, 65 respectively, which end or termination is intermediate the back surface 62 and front surface 63 of each shear blade 40, 41 as shown in the drawings. Each longitudinally extending recess portion 77 and 78 in the seal means 43 extends from its respective termination 79, 80 toward the back surface 62 of each plate 40, 41 and terminates in spaced relation thereto as illustrated at 77*a* and 78*a* in FIG. 3 of the drawings. The recess portions 77, 78 formed in the seal means 43 provide surfaces 77*b*, 78*b* adjacent each side surface 64, 65 which extend above or beyond the parallel surface 60 and are suitably conformed for sealingly and telescopically receiving the corresponding side surfaces of the opposed plate when the rams 13, 14 are moved to abutting relationship as shown in FIG. 1. The longitudinal recess portions 77, 78 form an intermediate portion 85 in the seal means 43 extending therebetween as shown. The rear portions *77c, 78c* of intermediate portion 85 adjacent the termination *77a, 78a* of each longitudinally extending recess portion 77, 78 are configured as shown to form converging surfaces which extend forwardly from the terminations *77a, 78a* sealingly receive the ends of the converging guide surfaces of the opposed shear blade.

The intermediate portion 85 of the seal means 43 which extends from the back surface 62 of each shear balde and forwardly towards the termination or ends 79, 80 of the longitudinally extending recess portions 77, 78 also is suitably shaped to sealingly receive the remainder of the shear surface 63 of the opposed shear blade and more particularly the acurate portion 70 and the tapered cutting surface 71. To this end the portion 85 is provided with projecting acurate configuration referred to generally at 90 which extends from the inner termination of the inwardly converging surfaces *77c, 78c* as shown. The acurate surface 90 is tapered or inclined downwardy and inwardly as represented at 91 for sealingly receiving the cutting surface 71 on the acurate portion 70 of the opposed shear surface.

The seal means 43 extends beyond the plane of the adjacent surface to which it is bonded, such as surface 60 to provide a seal of suitable thickness to enclose and telescopically receive the exposed forward portion 100 of the opposed blade on which no seal means is bonded. It can be appreciated, as previously noted, that a similarly configured seal means 43 is provided on the shear blade 41, and that indeed the shear blade 41 is identical to the shear blade 40, except that it is turned over when positioned in the shear ram 14 as shown in FIG. 7 of the drawings.

Thus, as the shear blades 40, 41 are moved their respective rams toward each other to shear or sever the elongated object as represented by the letter E in the drawings. The top surface of one blade slides immediately adjacent the bottom surface of the other blade and this produces a shearing action to sever the elongated object E. When the ends 95 of the rams of 40 and 41 are abutted, the ends 79, 80 formed by the termination of the longitudinally extending seal portions *43a, 43b* abut similar end portions on the seal means on blade 41.

Thus, the blades cooperate to telescopically receive each other in the seal means 43 bonded thereon to seal along the side surfaces 64, 65 as well as along the shear surface 63 including the guide surfaces 66, 67 acurate portion 70 and cutting surface 71 of each shear blade is sealingly engaged and enveloped by a seal surface of the seal means 43.

Figure 2:
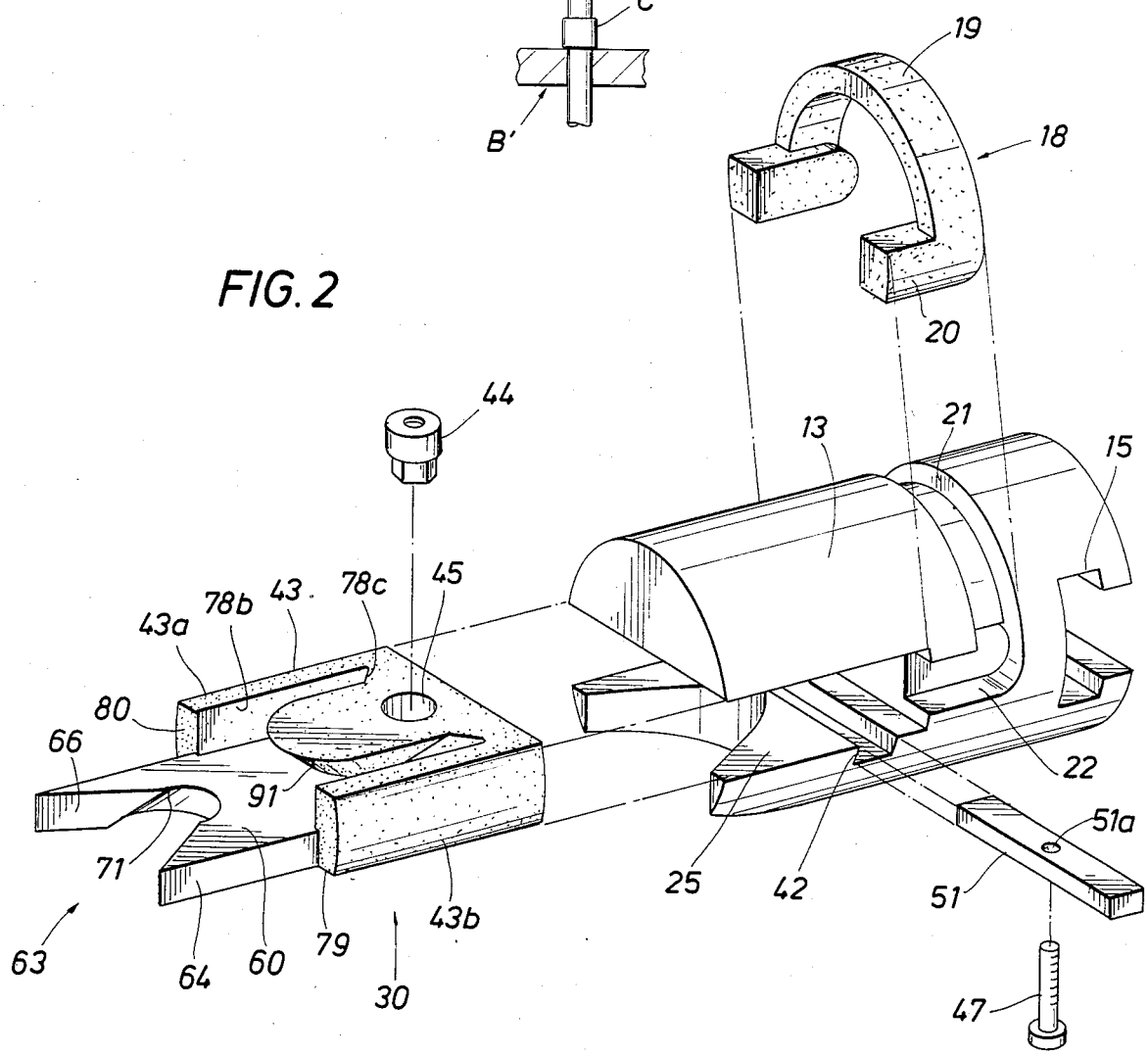
FIG. 2 is an exploded view of a shear ram and the seal blade associated therewith for a blowout preventer and the seal means associated with the ram and blade to seal off communication through the preventer when desired.

Each ram 13, 14 is provided with a central cut out portion F as shown in FIGS. 2 and 7 to receive the severed end of the elongated object E when the shear blade engages it as the shear blades 40, 41 move to sealing position within the seal means 43 on the opposed blade. More particularly, central portion F of ram 14 above slots 25 is cut away and the central portion F of the ram 13 beneath slot 25 is cut away as shown in FIG. 7. The complete cut away portion that is provided in each of the rams is better demonstrated in ram 13 in FIG. 2. The foregoing arrangement provides a shear which functions so as to sever elongated objects, and which inhibits collapsing them, particularly thin walled members. The seal arrangement on the shears by enclosing and sealing the exposed portion in the opposed shear blade inhibits communication through the shear support after the object has been severed.

DESCRIPTION OF OPERATION

The seal means 43 of each shear blade 40, 41 is formed and bonded on the blades in any suitable manner. The shear blades 40 and 41 are then removably mounted with their respective cylindrical rams 13 and 14, with one shear blade being turned over in relation to the other shear blade as previously described and as illustrated in FIG. 7 of the drawing. The cylindrical rams 13 and 14 are mounted in the blowout preventer B and the blowout preventer B is then positioned in the well bore in a manner well known in the art.

The elongated object E such as a tubular member or pipe extends through passage P in the preventer and between the opposed blades of each ram during normal operations conducted in a well bore.

If for any reason it should become necessary or desirable to sever the elongated object E such as a tubular member, the pipe rams of a blowout preventer B′ below the preventer B are closed around the pipe E beneath a pipe coupling or collar C and the pipe is lowered in the well bore until the collar C seats on the pipe rams of the preventer B′ as diagrammatically represented in FIG. 1. The rams 13, 14 are then moved towards each other and to closed position as demonstrated in FIG. 1 by any suitable power or manual means. As the rams 13 and 14 move towards each other to shear the tubular member E, the tapered cutting surfaces 71 of each blade 40, 41 serve to sever the pipe and urge the severed ends of the tubular member E along with the blades as they move toward telescoped relation. The blades 40, 41 continue to move and as they move severed ends of the tubular member are pushed by the thin blades 40, 41 to be received in the adjacent, respective cut out portion F on each ram face. For example, the upstanding severed end of the tubular member extending into the well bore beneath the closed rams 13, 14 is received in the portion F as viewed to the right in FIG. 7. The position of the severed pipe ends is diagrammatically represented in FIG. 1 immediately after the pipe E has been severed and with the shear rams in closed, abutting relation before they have been reciprocated to open position to enable fluid to be communicated to the upstanding open severed pipe end supported in the well bore on the pipe rams of preventer B′. Ordinarily, the pipe rams below the open upstanding end remain closed to prevent communication up the well bore around the pipe and to support the upstanding pipe end so that fluid can be conducted to the open upstanding end and into the well bore beneath the closed pipe rams to kill the well of for conducting other operations.

The foregoing disclosure and description are illustrative and explanatory of the invention, and various changes in the size, shape and materials as well as the details of the illustrated instructions may be made without departing from the spirit of the invention.

What is claimed is:

1. In a blowout preventer having a pipe passage with guideways extending laterally from opposite sides of the pipe passage, rams mounted in the guideways with opposed shear blades extending from the rams for movement between a spaced apart position to receive pipe in the pipe passage to an engaged position for shearing the pipe without crushing it and for sealing off the pipe passage, each ram having a face with a central cutout portion for receiving the uncrushed sheared pipe, the improvement comprising:

said opposed shear blades having generally flat upper and lower parallel surfaces with front, back and longitudinal side surfaces extending between said upper and lower parallel surfaces, said front surface forming a shear surface on said opposed shear blades;

said shear surface on each of said opposed shear blades including guide surfaces extending toward said back surface and coverging inwardly from said side surfaces, said guide surfaces terminating at their inner ends in an arcuate portion and said arcuate portion having an annular tapered cutting surface that extends on a diagonal plane between said upper and lower surfaces; and seal means on said opposed shear blades shaped to telescopically receive and sealingly engage said side and shear surfaces of said opposed blades when the rams are engaged to seal off the pipe passage when the pipe has been sheared.

2. The improvement of claim 1 wherein said seal means includes a first portion extending from said back surface on said opposed shear blades and along said longitudinal side surfaces and an additional portion extending over at least one of said parallel surfaces with both portions terminating in spaced relation from said front surface to provide each of said opposed shear blades with an arcuate shear surface, converging guide surfaces and a portion of said longitudinal side surfaces which are exposed whereby when the rams are engaged, said additional and first portion of said seal means sealingly engages respectively with said arcuate shear surface, converging guide surfaces and the portion of said longitudinal side surfaces of opposed shear blades which are exposed to seal off the pipe passage.

3. The improvement of claim 2 wherein said first portion of said seal means which extends along said longitudinal side surfaces of said opposed blades is spaced from said additional seal means portion which extends over at least one of said parallel surfaces to thereby form longitudinal recesses in said seal means, which recesses in said seal means terminate in spaced relation to said back surface for sealingly receiving therein the exposed portion of said longitudinal side surfaces when the opposed blades are engaged; and said additional seal means portion extending between said longitudinal recesses towards said shear surface and shaped to conform with and sealingly receive said arcuate shear surface and converging guide surfaces.

* * * * *